US006262703B1

(12) United States Patent
Perner

(10) Patent No.: US 6,262,703 B1
(45) Date of Patent: Jul. 17, 2001

(54) PIXEL CELL WITH INTEGRATED DC BALANCE CIRCUIT

(75) Inventor: Frederick A. Perner, Palo Alto, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 09/195,032

(22) Filed: Nov. 18, 1998

(51) Int. Cl.[7] ..... G09G 3/36
(52) U.S. Cl. ..... 345/90; 345/98
(58) Field of Search ..... 345/87, 90, 94, 345/92, 98, 96, 99

(56) References Cited

U.S. PATENT DOCUMENTS

| | | | |
|---|---|---|---|
| 4,432,610 | 2/1984 | Kobayashi et al. | 350/331 R |
| 5,471,225 | 11/1995 | Parks | 345/98 |
| 5,627,557 | 5/1997 | Yamaguchi et al. | 345/90 |
| 5,798,746 | 8/1998 | Koyama | 345/98 |
| 5,959,598 * | 9/1999 | McKnight | 345/90 |

FOREIGN PATENT DOCUMENTS

| | | | |
|---|---|---|---|
| 0586155 | 3/1994 | (EP) | G09G/3/36 |
| 0875881 | 11/1998 | (EP) | G09G/3/36 |
| 0965976 | 12/1999 | (EP) | G09G/3/36 |
| 2329035 | 3/1999 | (GB) | G02F/1/136 |
| WO97/04436 | 2/1997 | (WO) | G09G/3/36 |

* cited by examiner

*Primary Examiner*—Regina Liang

(57) ABSTRACT

A pixel within an array of pixels in which each pixel cell includes circuitry for generating its own DC balance data by utilizing the display data that is transferred to the pixel from an external source. Each pixel cell includes an initial storage node that branches into two separate storage nodes, the first of the branched nodes being used to store data that is used for display by the pixel and the second of the branched nodes being used to generate and hold the DC balance data. Once the display data has been displayed by the pixel, the DC balance data is multiplexed to the pixel and the pixel is driven according to the DC balance data. Generating the DC balance data within a pixel cell, instead of transferring DC balance data to the pixel cell from an external source, reduces the data transfer load to the pixel cell by approximately one-half.

19 Claims, 11 Drawing Sheets

PIXEL CELL WITH INTEGRATED DC BALANCE CIRCUIT

TECHNICAL FIELD

The invention relates generally to liquid crystal displays and more particularly to a liquid crystal display capable of storing video data.

DESCRIPTION OF THE RELATED ART

Liquid crystal displays (LCDs) have become a popular form of electronic displays. LCDs are composed of liquid crystals which are positioned between two pieces of glass. The crystals can be aligned such that in a normal state, light easily propagates through the liquid crystals. However, when an electrical field is present, the liquid crystals alter their alignment, greatly reducing the amount of light passing through the crystals. By applying an electrical field at different "pixels" or discrete regions on the LCD, an image can be formed on the LCD. An LCD can have more than 1,228,800 pixels. The resolution of the LCD is directly related to the density of pixels in the LCD array.

There are a number of alternative types of liquid crystals utilized commercially in LCDs. A first major type is referred to as twisted nematic liquid crystals. LCDs with twisted nematic liquid crystals produce pictures with high contrast. However, LCDs with twisted nematic liquid crystals have relatively narrow viewing angles, as well as slow molecular rotation times. A second type of liquid crystals is referred to as ferroelectric liquid crystals. LCDs with ferroelectric liquid crystals have wider viewing angles, because of their small cell gaps of 1 to 2 microns. In addition, ferroelectric liquid crystal displays (FLCDs) have a faster molecular rotation speed, typically in the range of 50 to 100 micro seconds.

A typical FLCD includes a display chip covered with a structure containing the ferroelectric liquid crystals, an illuminator, and viewing optics. Operation of a conventional FLCD is supported by a host computer and an external frame buffer memory. In order to display a color image on the FLCD, a frame of image data is transferred from the host computer to the external frame buffer memory. The external frame buffer memory supplies multi-bit pixel data to each pixel in the FLCD. The color image represented by the frame of pixel data is displayed on the FLCD as a result of a sequential process of loading each pixel of the FLCD with its multi-bit pixel data from the external frame buffer memory. Typically, each pixel in the FLCD has a single-bit storage register 10 and a pixel driver 12, as depicted in FIG. 1. Therefore, the external frame buffer memory must supply a series of single bits of pixel data to the pixels through the bit line 14 and word line 16 in order to display a particular color with a particular intensity at each pixel. The number of bits required for each pixel of FLCD to produce a desired color at a desired intensity may be 24 or more bits (e.g., three colors with eight bits of grayscale per color). In addition to the data that is required to display an image, equal and opposite DC balance data is required to be delivered to each pixel after the pixel has displayed a desired image. DC balance is utilized to extend the life of the liquid crystals and is well known in the art. While DC balance data is not visually displayed by the FLCD, the data is still supplied to the pixel from external circuitry.

Depending upon the transferred pixel data, light from the illuminator is either reflected to or deflected from the viewing optics. The pixels in the FLCD act as time-modulated micro mirrors in concert with the illuminator to produce the color image, which is determined by the values of the bits of pixel data. The quality of the color image is determined by the density of the pixels, the number of color-related bits within the pixel data transferred to each pixel, and the data transfer rate of the pixel data to the pixels. To display a high quality color image on the FLCD having the single-bit storage registers, a high bandwidth data link from the external frame buffer memory to the individual pixels is required for transferring the display data and the DC balance data. However, high bandwidth data links are expensive, potentially noisy, and require a great amount of power.

U.S. Pat. No. 4,432,610 to Kobayashi et al. (hereinafter Kobayashi) entitled "Liquid Crystal Display Device," describes LCDs with various storage elements in the pixels. All of the storage elements described in Kobayashi are single-bit storage elements. A concern with single-bit storage registers in an LCD is the need to continually supply bits of pixel data at a high data transfer rate to develop a high resolution image on the LCD. Unless a sufficiently high data transfer rate is achieved, there will be limitations on the size of the LCD array, the display frame rate, and/or the number of bits of pixel data that may be transferred per frame. These physical limits affect the quality of the display image.

Another LCD with single-bit storage elements is described in U.S. Pat. No. 5,471,225 to Parks entitled "Liquid Crystal Display with Integrated Frame Buffer." The single-bit storage elements in the LCD of Parks are static random access memory (SRAM) cells comprised of three transistors and two resistors. The SRAM cells allow the LCD to display an image for an indefinite amount of time without refreshing. However, the data transfer rate concern identified above for the LCDs of Kobayashi exists for the LCD of Parks.

U.S. Pat. No. 5,627,557 to Yamaguchi et al. (hereinafter Yamaguchi) entitled "Display Devices," describes an improved pixel for an LCD. The pixel includes circuitry for storing a first bit of display data while displaying a second bit of display data. In addition, Yamaguichi discloses a circuit integrated into the pixel cell that includes a sample-and-hold capacitor for holding a negative scanning signal which may be used for DC balancing. While DC balance data is held simultaneously with display data in the pixel cell, the DC balance data is created by external drive circuitry and transferred from an external frame buffer through the bit line of the pixel cell.

In view of the expense of high bandwidth links between the frame buffer and the display pixels and the large volume of display data required to generate high resolution video images, what is needed is a pixel cell that enables a reduction in the requirements of transferring display data and DC balance data to a pixel cell.

SUMMARY OF THE INVENTION

A method and an apparatus for reducing data transfer requirements to a pixel cell involve an array of pixels in which each pixel cell includes circuitry for generating its own DC balance data by utilizing display data that is transferred to the pixel from an external frame buffer or other source of the display data. Each pixel cell includes an initial storage node that branches into two separate storage nodes, with the first of the branched nodes being used to store data that is used to determine the display condition of the pixel and the second of the branched nodes being used to generate and hold the DC balance data. Once the display data has been utilized for display purposes by the pixel, the DC balance data is multiplexed to the pixel and the pixel is driven according to the DC balance data. By generating the DC balance data within the pixel cell, instead of transferring DC balance data to the pixel cell from an external source, the data transfer load to the pixel cell is reduced by approximately one-half.

In a preferred embodiment, a pixel cell with two bits of memory and DC balance generation capability includes an input storage block, a frame transfer block, a drive storage block, a DC balance block, a multiplexer, and a pixel driver. The input storage block includes a circuit for storing a bit of display data that is received from an external display buffer through a write bit line and a write word line. The input storage block consists of three NMOS transistors arranged to create a dynamic storage node. In addition, the input storage block provides a global reset signal that resets the dynamic storage node upon activation of the reset signal. Operation of the input storage block involves sending a pulse to a selected write word line, allowing a bit to be read into the storage node from the write bit line.

The frame transfer block is a circuit that allows an entire frame of data to be transferred simultaneously to all of the pixel drivers in an array of pixel cells, instead of scrolling the data to the pixel drivers. A frame transfer is triggered by a global transfer signal that is received from a global timing block. The frame transfer block consists of two NMOS transistors and one dynamic storage node. The two NMOS transistors are located on two separate conductive paths that split from the dynamic storage node, with one conductive path connecting to the drive storage block and the other conductive path connecting to the DC balance block.

The drive storage block is a dynamic storage node that holds a bit of display data that is utilized by the pixel driver to drive a pixel. The drive storage block is formed by a current path that extends from the drain of a transistor in one branch of the frame transfer block to the gate of a transistor in the pixel driver. The drive storage block functions to carry display data from the input storage block to the pixel driver. The combination of the bit of display data stored in the input storage block and the bit of display data stored in the drive storage block creates a pixel cell with two bits of memory.

The DC balance block generates DC balance data from the branch of the display data that is received from the input storage block. The DC balance block stores the DC balance data until it is time to drive the respective pixel. The DC balance block consists of four NMOS transistors connected to create two dynamic storage nodes. The first storage node receives the display data during the frame transfer and the second storage node stores the DC balance data that is generated in response to the display data that is received during frame transfer.

The multiplexer block controls when the drive storage data and the DC balance data will be received by the pixel driver. The multiplexer block consists of two NMOS transistors with one transistor operating to reset the drive storage block to a known state and the other transistor operating as a switch between the DC balance block and the drive storage block. In order to control the pixel driver from the DC balance block, an invert signal is pulsed on one of the two transistors, transferring the DC balance data to the pixel driver.

The pixel driver block receives display data from the drive storage block and DC balance data from the DC balance block. The pixel driver controls the voltage supplied to a pixel in accordance with the received display data or DC balance data. The pixel driver block consists of one NMOS transistor and one PMOS transistor connected to form a dynamic storage node. An induced transition or non-transition of the dynamic storage node within the pixel driver determines the voltage with which the liquid crystal will be driven.

Operation of a single pixel cell requires a series of reset and precharge stages, followed by reading of display data and transferring of the display data to the pixel driver. The initial reset/precharge stage involves resetting the drive storage block to a known state, resetting and precharging the DC balance block to known states, and precharging the pixel driver to a known state. Writing data to the input storage block involves pulsing the write word line and allowing a bit of data to pass from the write bit line to the input storage block. If the bit of data is a "1" the input storage node will be charged high and, conversely, if the bit of data is a "0" the input storage node will be charged low. Because the pixel cell operation is slightly different depending on whether a "1" or a "0" is written to the input storage block, the two situations are discussed separately with the "1" bit case described first and the "0" bit case described second.

To transfer the stored "1" bit of display data from the input storage block to the pixel driver, the transistors of the global transfer block are activated by pulsing the global transfer signal. Pulsing the global transfer signal transfers a high signal simultaneously to the drive storage block and the DC balance block. The high signal at the drive storage block activates a transistor in the pixel driver and transitions the storage node of the pixel driver from precharged high voltage to a low voltage. The transition of the storage node in the pixel driver from high to low is equivalent to driving the pixel with a "1" bit. The high signal at the drive storage block is also simultaneously transferred to the DC balance block, causing the first storage node within the block to transition from low to high. The transition from low to high activates a transistor and drops the second node from high to low, thereby generating the DC balance data that is subsequently transferred to the pixel driver.

After the "1" bit has been displayed by the pixel driver for the desired time, it is necessary to drive the pixel according to the DC balance data. Instead of writing the DC balance data from the write line as is known, the pixel cell utilizes the DC balance data that is generated internally to drive the pixel cell. Utilizing the DC balance data requires a reset/precharge operation in which the drive storage node is dropped to a known state and the pixel driver is charged to a known state. Upon completion of the reset/precharge operation, the newly generated DC balance data is transferred from the DC balance block to the pixel driver by pulsing an invert signal within the multiplexer. The invert signal releases the low charge held at the second node of the DC balance block to the pixel driver and since the node is low, the charge does not have any effect on the precharged node of the pixel driver. As a result, the pixel is driven at a voltage that is the inverse of the display data, thereby accomplishing DC balancing with data that was generated within the pixel cell.

In the case where a "0" bit is initially written to the input storage block, when the global transfer signal is activated, the drive storage block and the DC balance block simultaneously receive low signals. The low signal received by the drive storage block is transferred to the pixel driver, but does not cause the storage node of the pixel driver to transition from high to low. Likewise, the low signal transferred to the DC balance block does not cause the second storage node within the DC balance block to transition from high to low.

After the "0" bit has been displayed by the pixel driver for the desired time interval, the DC balance reset/precharge operation is initiated. As with the case of a displayed "1" bit, the DC balance reset/precharge operation involves resetting the drive storage block to a known state and precharging the pixel driver to a known state. Once the DC balance reset/precharge operation is complete, an invert signal is pulsed in the multiplexer and the DC balance data stored in the second node of the DC balance block is transferred to the pixel driver. Since the storage node within the DC balance block is charged high, the pixel driver is transitioned from high to low, thereby driving the pixel with an opposite signal as the display data.

Advantages of the invention include a greater illumination efficiency over a 1-bit display pixel, the potential elimination of color flicker, a reduced display frame rate, and a reduction in the frame buffer to pixel cell interface bandwidth requirement by approximately one-half. Another advantage of the 2-bit pixel over a 1-bit pixel is that the 2-bit pixel allows a change in operation from a scrolling display to a global transfer display.

DETAILED DESCRIPTION

Figure 1:
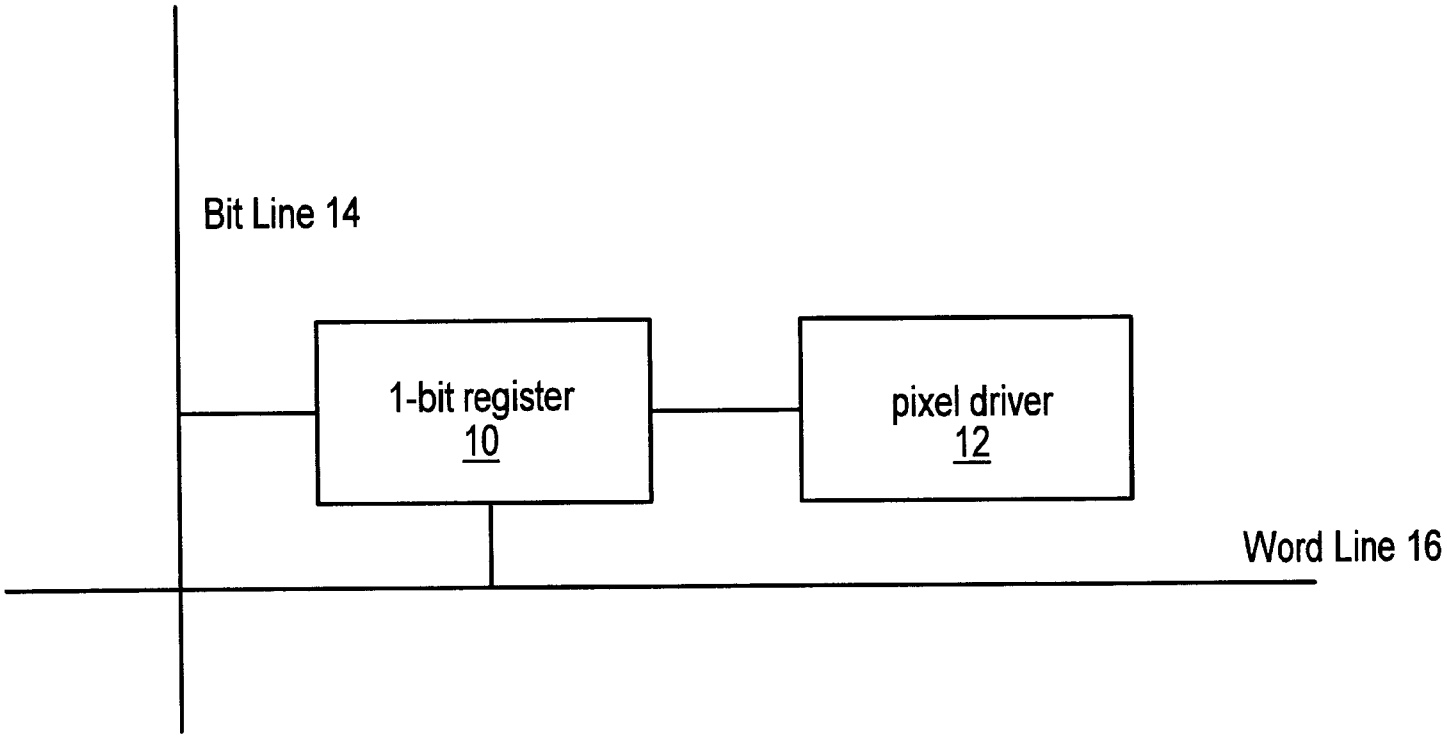
FIG. 1 (PRIOR ART)
FIG. 1 is a depiction of a pixel having a 1-bit storage register and a pixel driver in accordance with the prior art.
Figure 2:
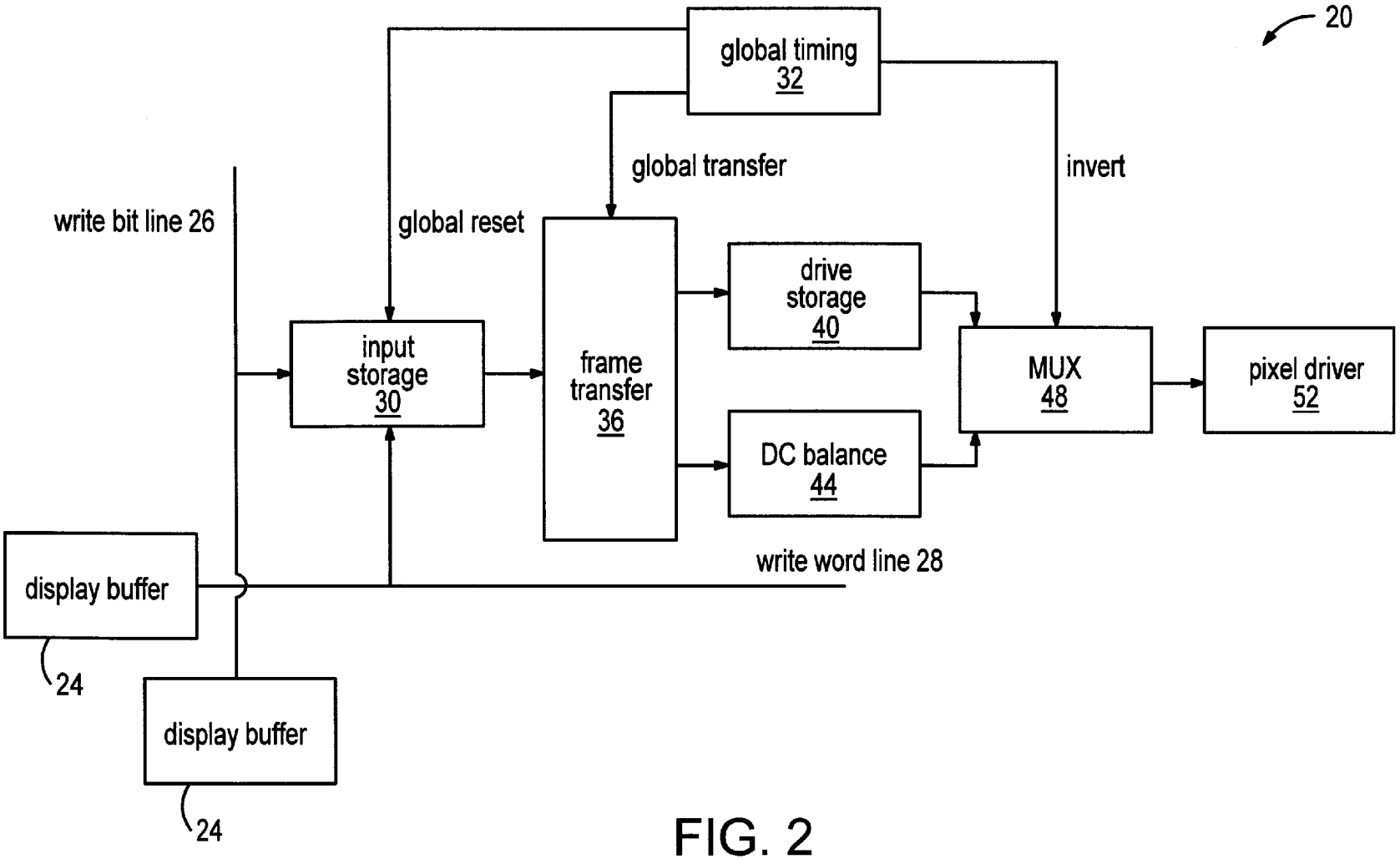
FIG. 2 is a block diagram of a single pixel cell having 2-bit storage capability as well as internal DC balance generation in accordance with the invention.

FIG. 2 is a block diagram of a single pixel cell 20 in accordance with the invention. The pixel of FIG. 2 is one pixel cell in a matrix of pixels that are combined to form a display device. Each block of FIG. 2 is described individually, followed by a description of the overall operation of a pixel cell in accordance with the invention.

As is known in the art of liquid crystal displays (LCDs), data is supplied to each pixel cell from external drive circuitry and/or display buffers 24 through a write bit line (wbl) 26 and a write word line (wwl) 28. The write bit line, also known as the data line, supplies voltage to the pixel that represents display data as "1"s and "0"s. The write word line, also known as the scanning signal line, provides a mechanism to control when data is read from the write bit line. An entire display includes a matrix of write bit lines and write word lines connected to the array of pixel cells to provide individual control of each pixel in the display.

The global timing block 32 is a conventional periphery system that controls the timing of all of the pixels in the display device. In addition to conventional timing signals, the global timing block generates a global reset signal, a global transfer signal, and an invert signal for each pixel. The global reset, global transfer, and invert signals are specific to the invention and are described in detail below.

Figure 3:
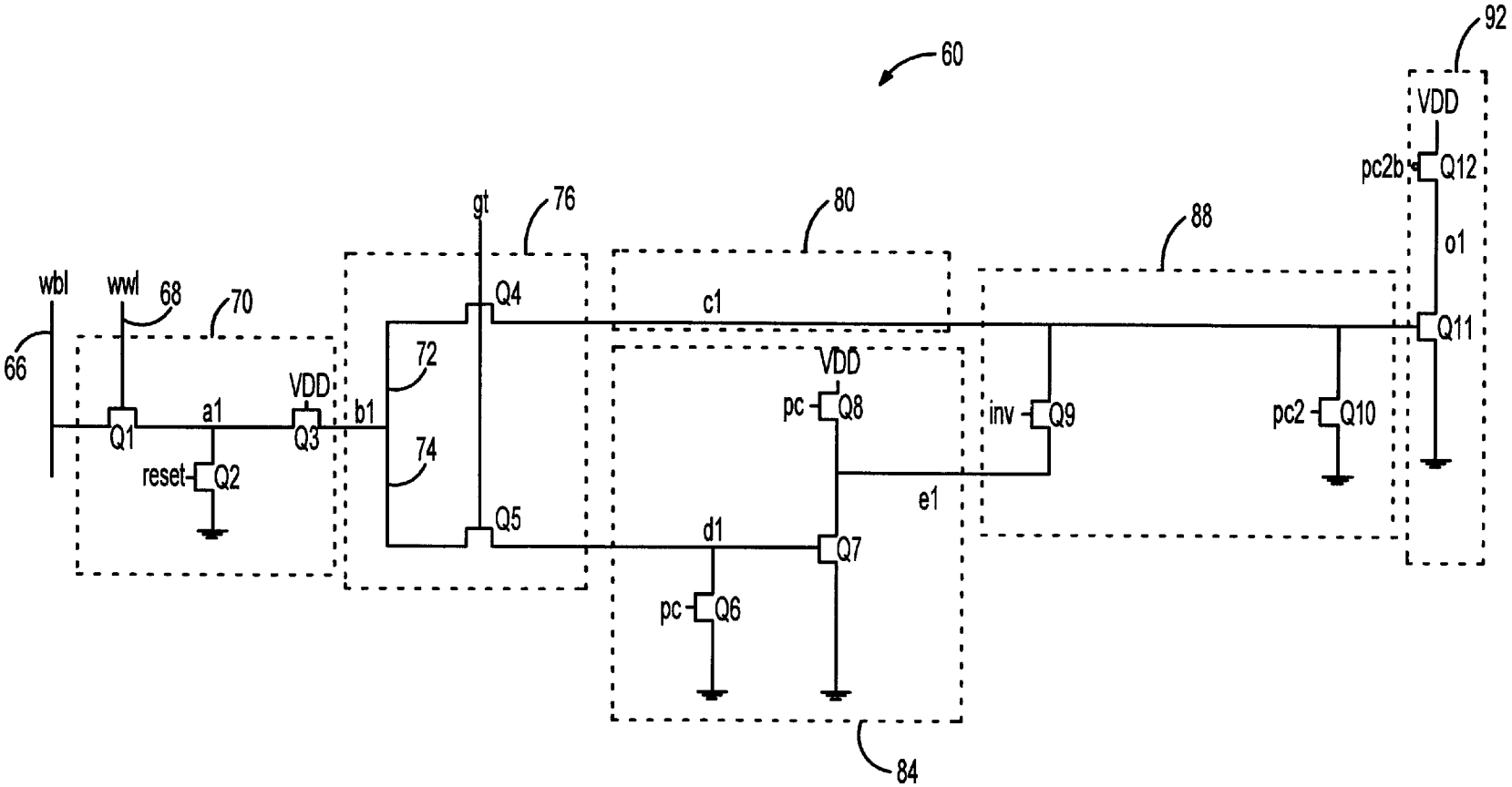
FIG. 3 is a circuit diagram of a single pixel cell having 2-bit memory and DC balance generation capability in accordance with the invention.

The input storage block 30 includes a circuit that stores a bit of data. The bit of data, referred to throughout as the input bit, is received from the display buffer 24 and is the next bit of display data that will be utilized to drive the pixel. A preferred pixel cell circuit layout 60 of the pixel cell of FIG. 2 is depicted in FIG. 3, with the input storage block being identified by dashed line box 70. The input storage block consists of three NMOS transistors Q1, Q2, and Q3, arranged to create a dynamic storage node at a1. The source of Q1 is connected to the write bit line 66 and the gate of Q1 is connected to the write word line 68. The drain of Q1 is connected to the source of Q2 and to the source of Q3. The gate of Q2 is connected to receive the global reset signal and the drain of Q2 is connected to ground. Q3 functions as a storage capacitor, with the gate of Q3 being connected to $V_{DD}$ (typically five volts) and the drain being connected to node b1.

Operation of the input storage block involves pulsing the write word line, allowing a bit to be read from the write bit line. When the write bit line is high, node a1 goes to high and is held high by Q3. The global reset signal (reset) is used to initialize a display for frame blanking or for test and calibration of the pixel array, where the entire array may be activated to a known state without the need to be connected to a source of display data. The global reset signal is "global" because it has the ability to reset the input storage block of all the pixels in the array.

Referring back to FIG. 2, the frame transfer block 36 is a circuit that allows an entire frame of data to be transferred simultaneously to all pixels in an array, instead of scrolling the data to pixels as is conventional in the art. A frame transfer is triggered by a global transfer signal received from the global timing block 32. A preferred circuit layout for the frame transfer block 36 is depicted in FIG. 3 by dashed line box 76. The frame transfer block consists of two NMOS transistors Q4 and Q5 and one dynamic storage node b1. As can be seen, the drain of Q3 is split into two separate conductive paths 72 and 74 at node b1. One conductive path 72 travels from the input storage block to Q4 and to a drive storage block 40 and 80, and the other conductive path 74 travels from the input storage block to Q5 and to a DC balance block 44 and 84. The gates of both Q4 and Q5 are triggered by the global transfer signal, which allows the data at node b1 to be transferred to nodes c1 and d1. That is, if node b1 is high when the global transfer signal is pulsed, then nodes c1 and d1 will be high, and if node b1 is low when the global transfer signal is pulsed, then nodes c1 and d1 will remain at a precharged low state. Enabling display data to be transferred to pixel drivers on a frame basis eliminates the need for blank frames and allows color bits to be interleaved to minimize color flicker.

Referring to FIG. 2, the drive storage block 40 is a storage node that holds the bit of display data that is utilized by the pixel driver 52. The bit of display data is referred to as the drive bit and is preferably represented as either a high voltage or a low voltage. The drive storage block is depicted in FIG. 3 by dashed line box 80 and does not include any transistors. The drive storage block identified by dynamic storage node c1 is formed by the current path that extends from the drain of Q4 to the gate of Q11. In operation, node c1 can be preset low by a pulse from the signal pc2 of transistor Q10 and when node c1 is high, the gate of Q11 is activated. The combination of the input bit stored at the input storage block and the display bit stored at the drive storage block provides two bits of memory for the pixel cell.

The DC balance block 44 shown in FIG. 2 generates DC balance data from display data that is received from the input storage block 30 and then stores the DC balance data until it is time to drive the pixel. A preferred circuit layout for the DC balance block is depicted in FIG. 3 by dashed line box 84 and consists of four NMOS transistors Q6, Q7, Q8, and Q9 connected to create the dynamic storage nodes d1 and e1. Node d1 is at the junction of the drain of Q5, the source of Q6, and the gate of Q7 and node e1 is at the junction of the drain of Q8, the source of Q7, and the source of Q9. Transistors Q6 and Q8 are activated by a global precharge (pc) signal. Precharging of the DC balance storage block involves pulsing the pc signals of Q6 and Q8, which has the effect of pulling node d1 low (to ground) and charging node e1 high (to $V_{DD}$).

The multiplexer block 48 shown in FIG. 2 controls when the drive storage data and the DC balance data will be received by the pixel driver 52. A preferred circuit layout for the multiplexer is depicted in FIG. 3 by dashed line box 88 and consists of two NMOS transistors Q9 and Q10. In operation, the pixel driver is normally controlled by the drive storage block 40. In order to control the pixel driver from the DC balance block, the pc2 signal is first pulsed to ensure that node c1 is low. After pulsing pc2, the inv signal is pulsed and the data at node e1 is sensed by the pixel driver. When e1 is initially high, pulsing the inv signal activates the gate of Q11, dropping node o1 to low and when e1 is initially low, pulsing the inv signal does not activate the gate of Q11.

The pixel driver block 52 shown in FIG. 2 receives display data from the drive storage block 40 and DC balance data from the DC balance block 44 and controls the voltage supplied to the pixel in accordance with the received data. A preferred circuit layout for the pixel driver block is depicted in FIG. 3 by dashed line box 92 and consists of one NMOS transistor and one PMOS transistor connected to form a dynamic storage node o1. As shown, node o1 is formed at the junction of the source of Q11 and the drain of Q12. The gate of Q11 is activated by signals from nodes c1 or e1 and the gate of Q12 is activated by the precharge signal pc2*b*, which is the inverse of the precharge signal pc2. Operation of the pixel driver block involves precharging node o1 to high by pulsing the pc2*b* signal. Once precharged, if the gate of Q11 is activated, node o1 will go from high to low with the transistor driving the attached liquid crystal accordingly. On the other hand, if the gate of Q11 is not activated, then node o1 will not transition and the liquid crystal will be driven accordingly. Driving a liquid crystal with a PMOS transistor enables the drive signal to have a full $V_{DD}$ to ground voltage swing.

Pixel cells as described with reference to FIGS. 2 and 3 may be implemented, for example, into a VGA display having 640×480 pixels and/or a QGA display having 1280×960 pixels. The memory cells may be fabricated with, for example, 0.35 micron or 0.18 micron CMOS processes, respectively.

Figure 4:
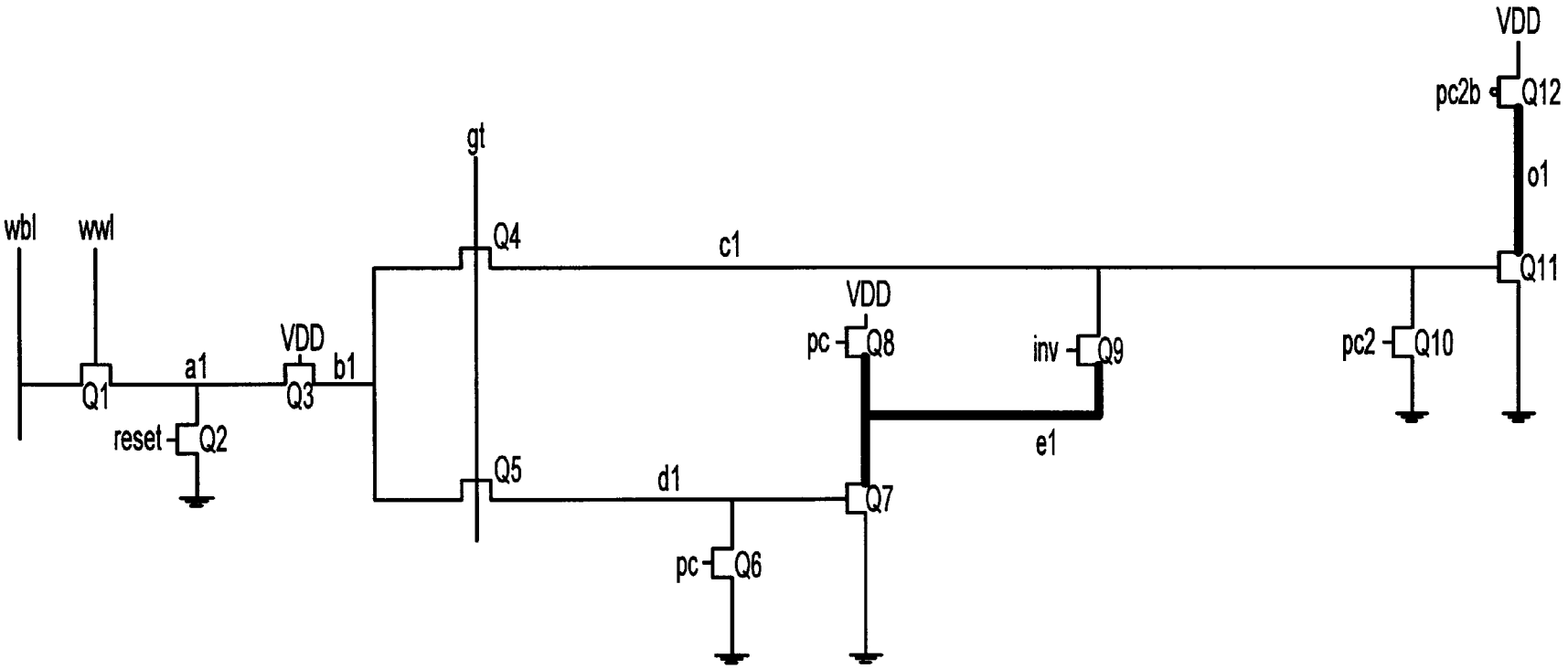
FIG. 4 is a depiction of a preset stage of a single pixel cell in accordance with the invention.

Operation of a single pixel cell 20 and 60 is described in stages with reference to FIGS. 4–11, where a bold line indicates a conductive path that is charged to a high voltage. FIG. 4 depicts a reset/precharge stage in which signals reset, pc, pc2, and pc2*b* are all pulsed. Pulsing the reset signal sets node a1 low. Pulsing the pc signal sets node d1 low and precharges node e1 high (to $V_{DD}$), as indicated by the bold line. Pulsing the pc2 signal sets node c1 low and pulsing the pc2*b* signal precharges node o1 high, as indicated by the bold line. The reset/precharge stage is a fundamental procedure necessary to initialize the dynamic pixel driver and sets up the pixel cells, so that only high signals applied to node c1 will cause node o1 to transition from high to low.

Figure 5:
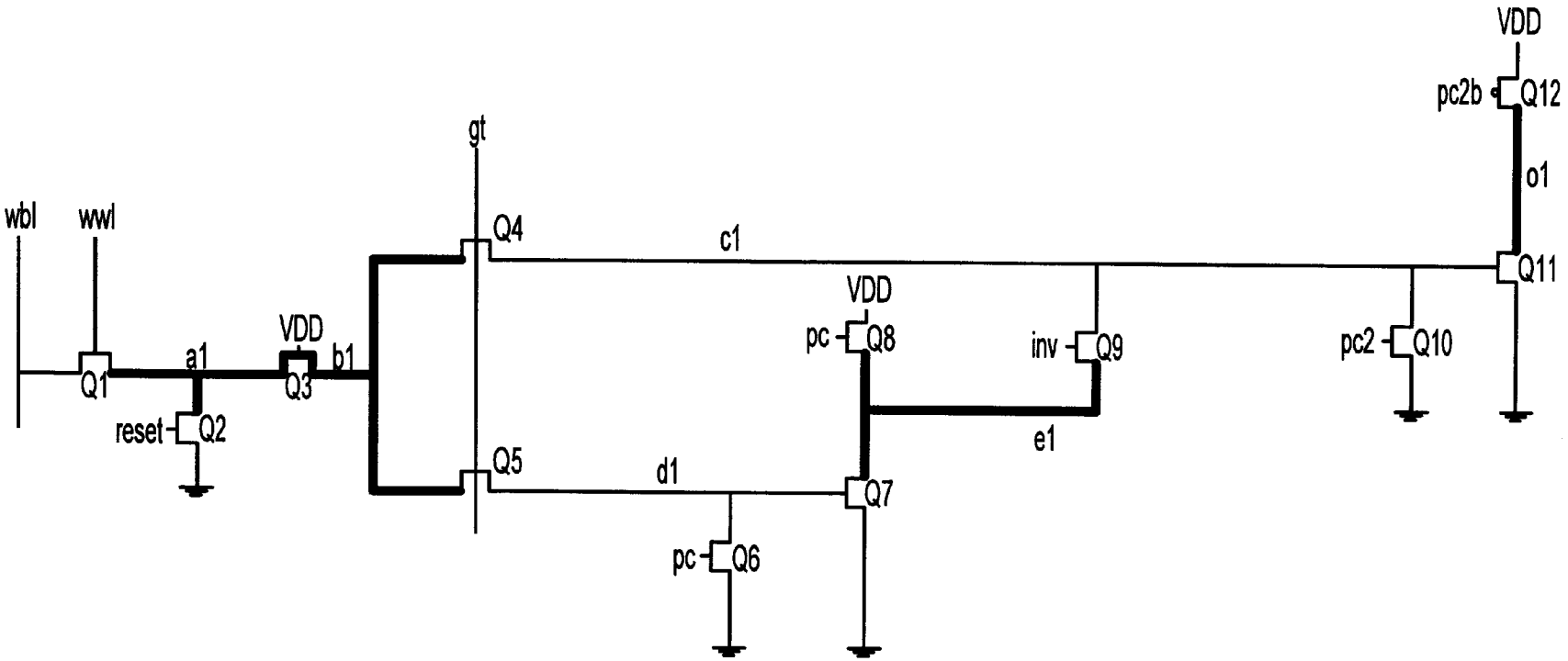
FIG. 5 is a depiction of a data writing stage of a single pixel cell in accordance with the invention.

Data writing is performed after the pixel cell is reset/precharged as described above. In the data writing stage, a bit of data is written from the write bit line to node a1. Referring to FIG. 5, to write a bit of data to node a1, the write word line signal is pulsed high, thereby activating Q1 and allowing a bit of data to pass from the write bit line to node a1. If the write bit line is high, then a1 will change from low to high and node a1 will represent a "1". If the write bit line is low, then a1 will remain low and node a1 will represent a "0". When al is high, Q3 acts as a storage capacitor to hold the bit value supplied by the write operation. FIG. 5 is depiction of a pixel cell after a "1" bit has been written to node a1 and stored in the input storage block. As shown, the bold line indicates a conductive path that is charged high. It is important to note that when al is high b1 is also high and that Q4 and Q5 prevent further transfer of the high charge. In addition, it is important to note that nodes e1 and o1 are not affected by the write and store operation that has occurred at the input storage block. In the case where a "0" is written to node a1, the charging of the pixel cell remains exactly as shown in FIG. 4, where nodes a1 and b1 remain low.

Figure 6:
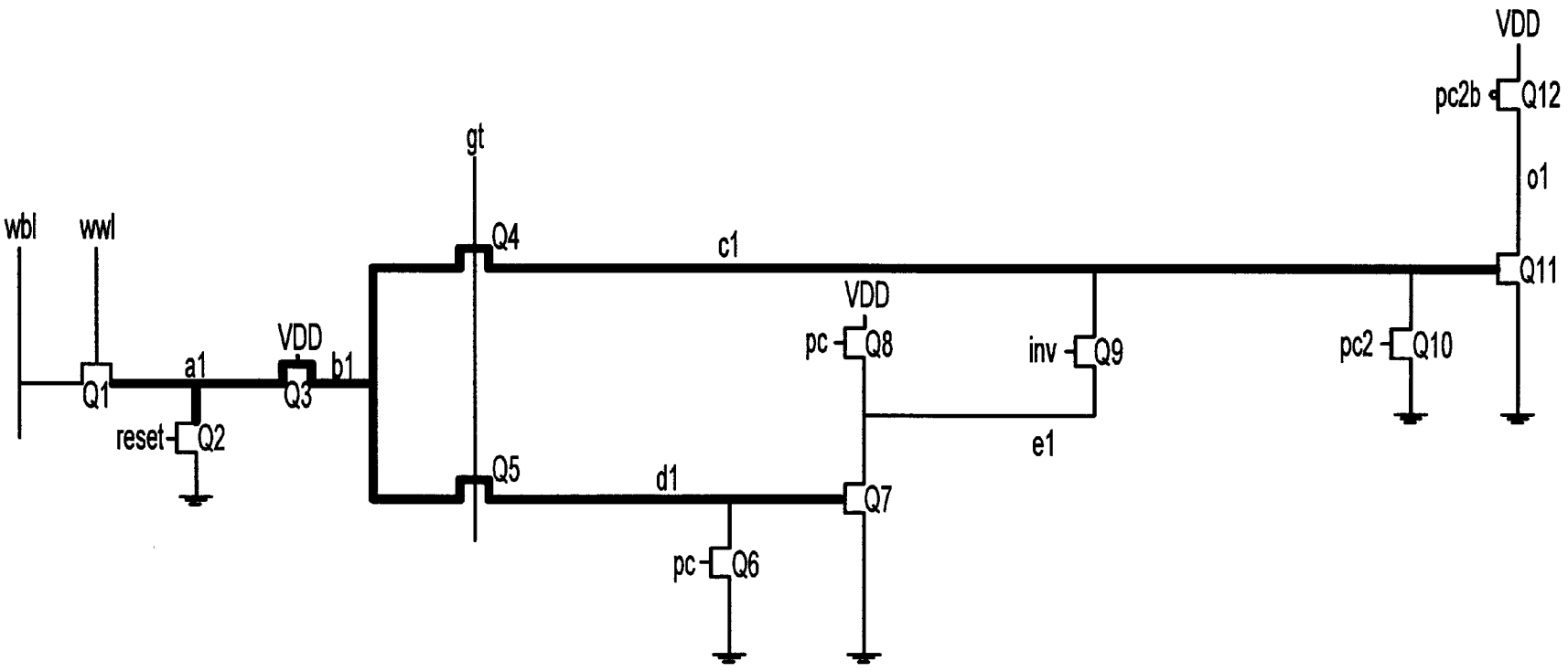
FIG. 6 is a depiction of a frame transfer stage of a single pixel cell in accordance with the invention.

Because the pixel cell operation is slightly different depending on whether a "1" or a "0" is written to the input storage block, the two situations are discussed separately with the "1" bit case described with reference to FIGS. 5–8 and the "0" bit case described with reference to FIGS. 9 and 10. As shown by the bold line at nodes a1 and b1 in FIG. 5, a "1" is stored in the input storage block. To transfer the stored bit to the pixel driver so that the bit can be transformed into display data, the transistors Q4 and Q5 of the global transfer block are activated by pulsing the global transfer signal. Referring to FIG. 6, pulsing the global transfer signal transfers a high signal simultaneously to nodes c1 and d1. The high signal on node c1 turns on Q11 and causes node o1 to transition from high to low. The transition of node o1 from high to low is equivalent to driving the pixel with a "1" bit. The high signal on node d1 turns on Q7 and drops node e1 from high to low, creating the DC balance data for subsequent transfer to the pixel driver.

Figure 7:
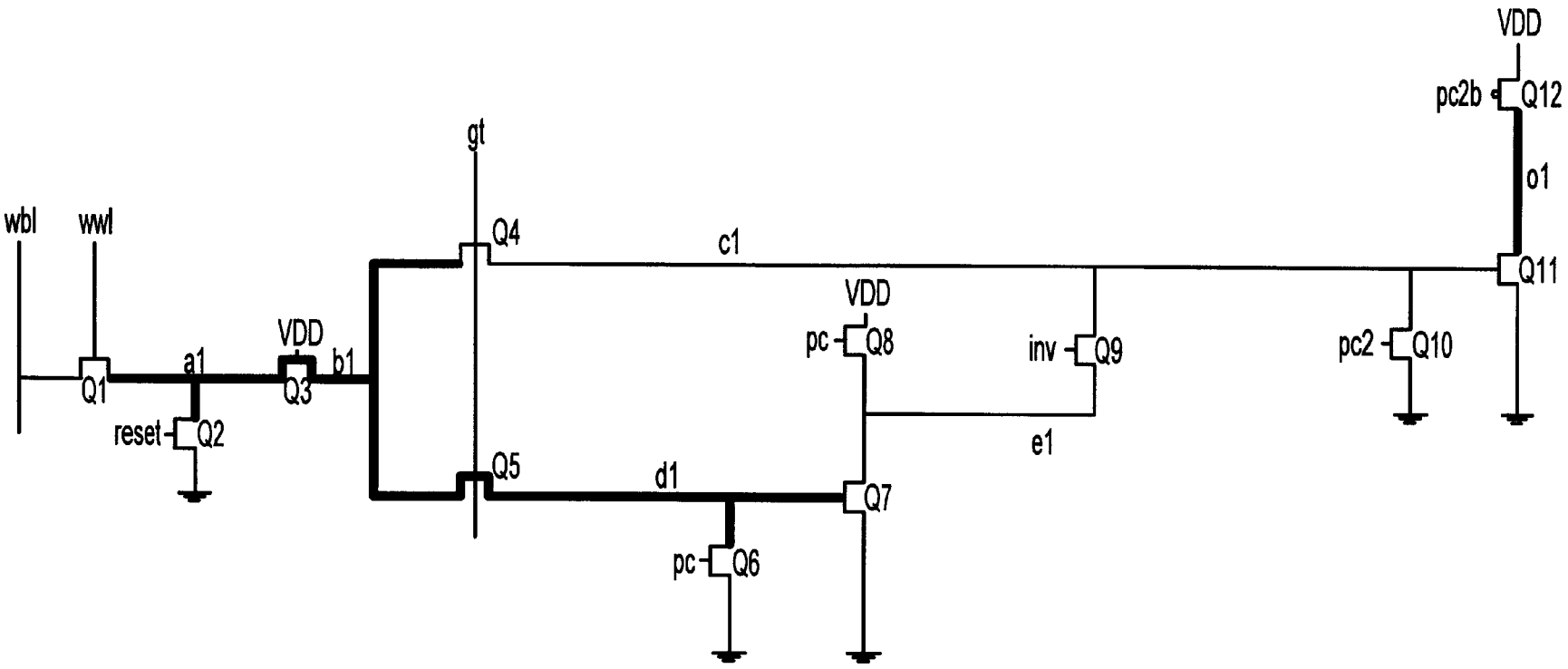
FIG. 7 is a depiction of a DC balance preset stage of a single pixel cell in accordance with the invention.

After the "1" bit has been displayed by the pixel for the desired time, it is necessary to drive the pixel with an inverted, or negative, signal for an equivalent period of time to accomplish DC balancing. Instead of writing the DC balance data from the write bit line, as is conventional, the pixel cell utilizes the internally generated DC balance data. To prepare the pixel cell for the DC balance data transfer, the pixel cell again must be reset/precharged by pulsing the pc2 and pc2*b* signals. FIG. 7 depicts a pixel cell after the DC balance reset/precharge in the case in which a "1" was just transferred from the input storage node. Pulsing pc2 turns on Q10 and causes node c1 to go low if it was high (as is the case when a "1" was just transferred) and pulsing pc2*b* turns on Q12, causing node o1 to go high if it was low (as is the case when a "1" was just transferred). In addition, it should be noted that node d1 remains charged, but more importantly node e1 is no longer charged because node e1 was dropped low when Q7 was turned on by the frame transfer.

Figure 8:
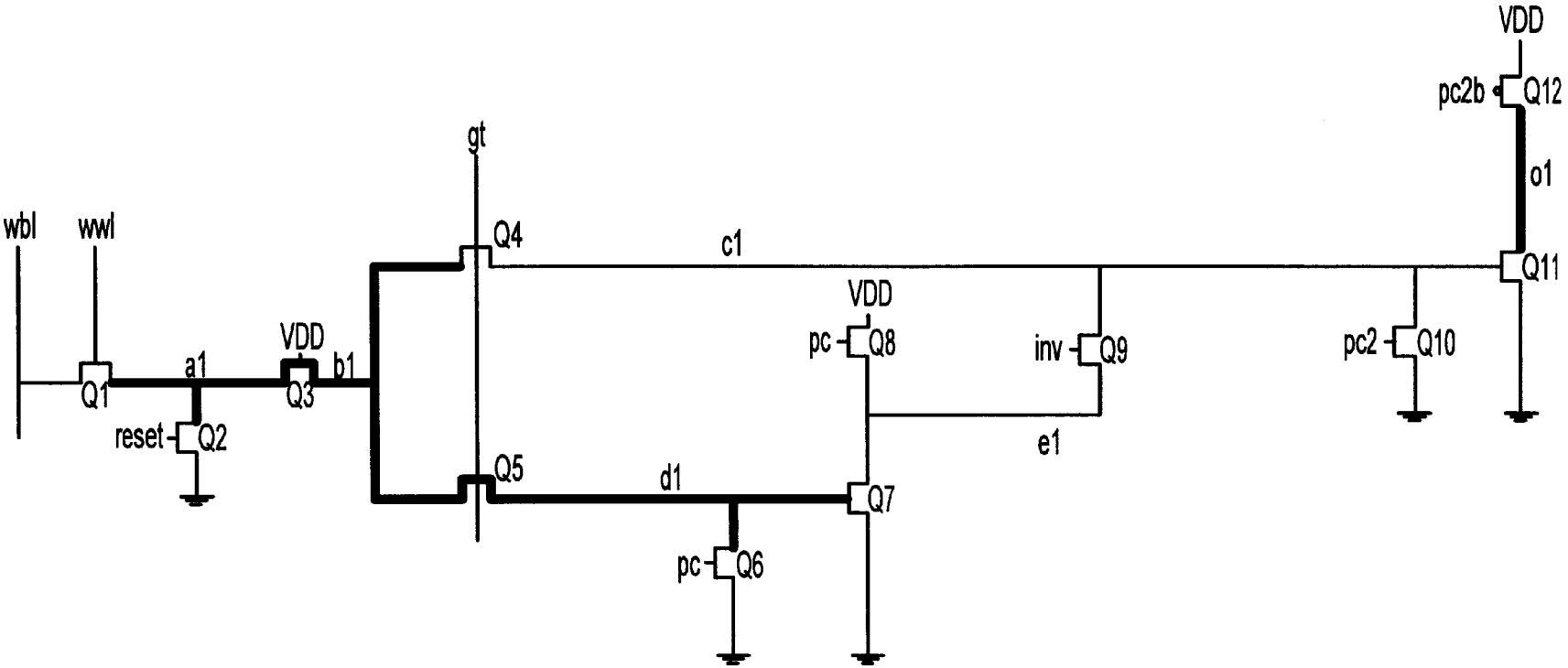
FIG. 8 is a depiction of a DC balance stage of a single pixel cell in accordance with the invention.

Referring to FIG. 8, to transfer the DC balance data to the pixel driver, the inv signal is pulsed, causing the data at node e1 to be transferred to node c1 and to the gate of Q11. In the case when a "1" is initially transferred from the input storage block, node d1 is high and node e1 is low. Since node e1 is low, pulsing the inv signal does not turn on Q11 and therefore node o1 remains high. Leaving node o1 high causes the pixel to be driven at the equivalent of a "0" bit during DC balancing.

Figure 9:
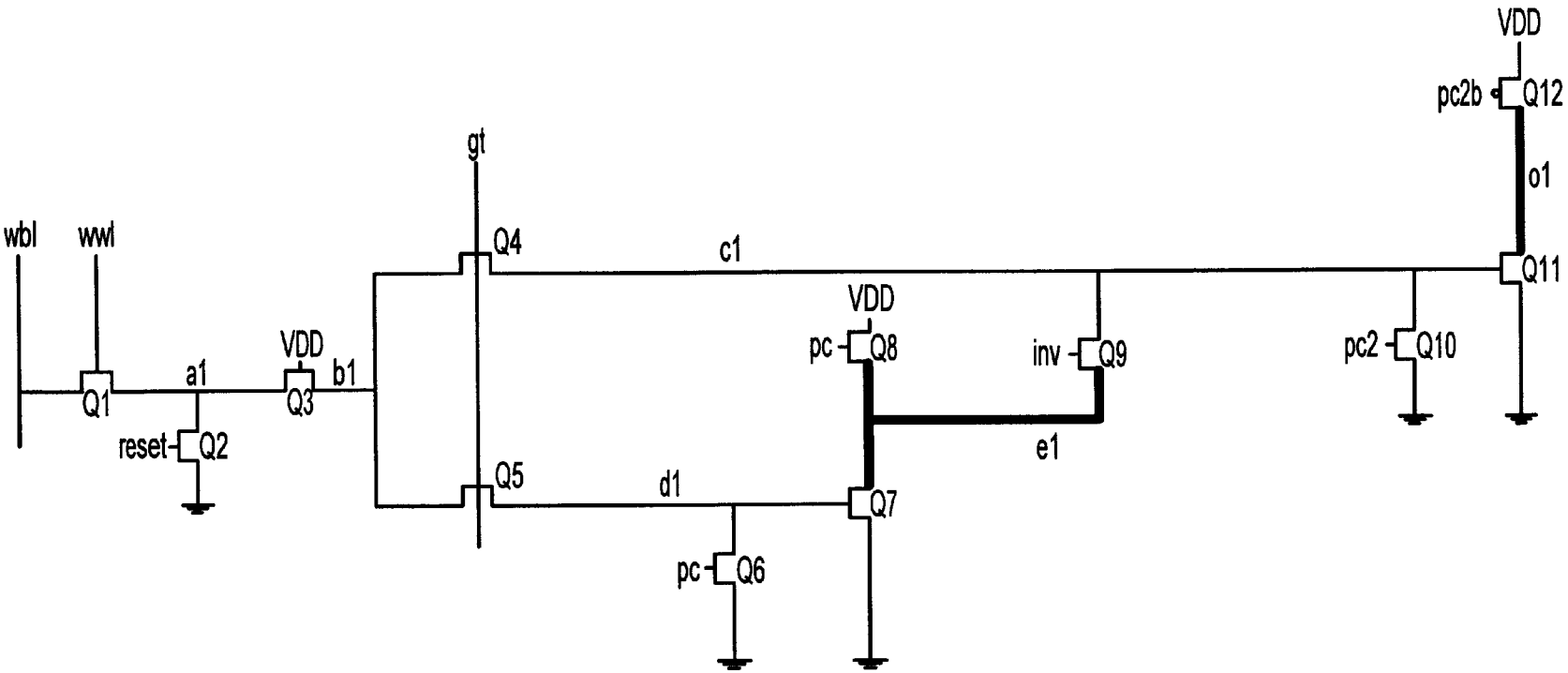
FIG. 9 is a depiction of a frame transfer stage of a single pixel cell in accordance with the invention.
Figure 10:
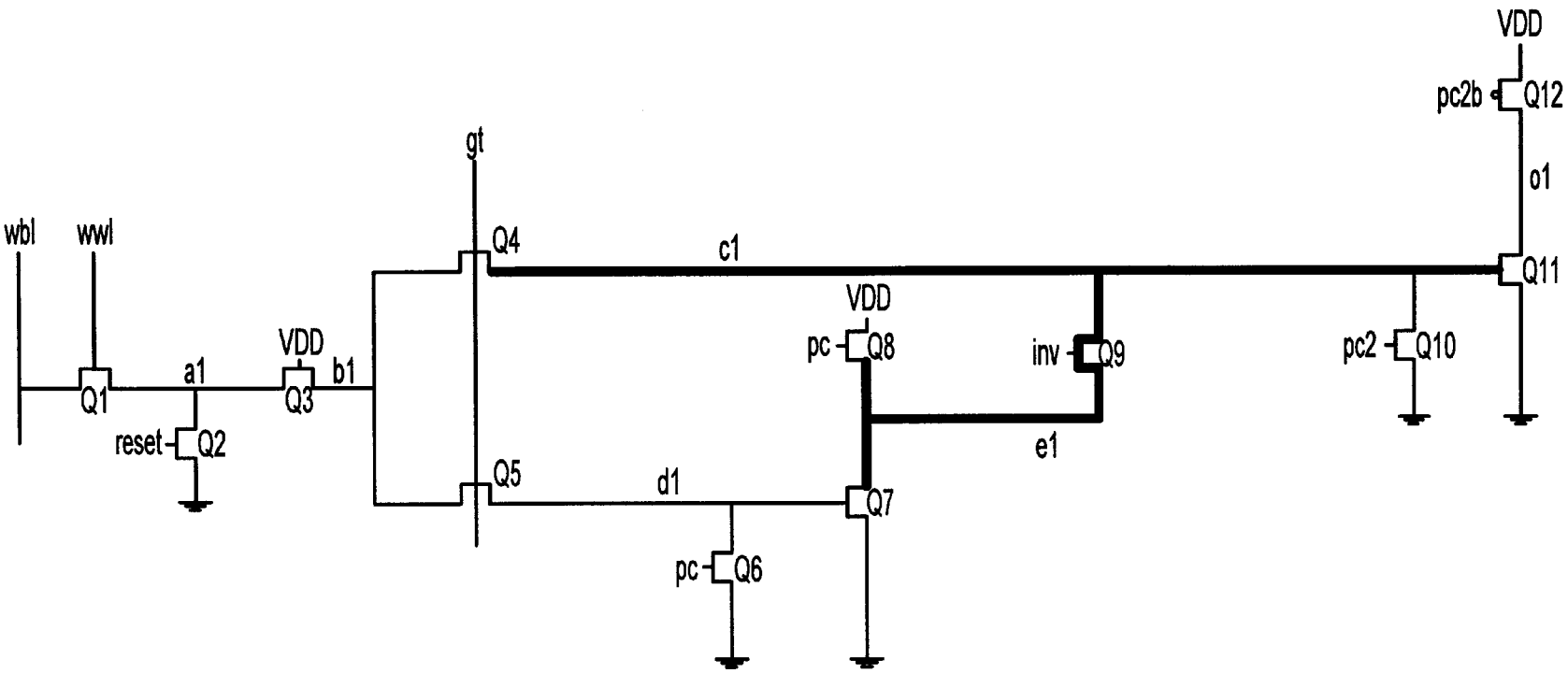
FIG. 10 is a depiction of a DC balance stage of a single pixel cell in accordance with the invention.

FIGS. 9 and 10 are referred to in the case in which a "0" bit is initially written into the input storage block. Referring to FIG. 9, as described above, after a "0" bit has been written from the write bit line into node a1, node a1 remains low. Since node a1 is low when the global transfer signal is activated, nodes c1 and d1 remain in their preset low states. Since node c1 remains low, Q11 is not activated and as a result node o1 remains high, driving the pixel according to a "0" bit. Since node d1 remains low, Q7 is not activated and as a result node e1 remains high.

After the "0" bit has been displayed for the desired time interval, the DC balance reset/precharge operation is initiated. As with the case of a displayed "1" bit, the DC balance reset/precharge operation involves pulsing the pc2 signal and pulsing the pc2*b* signal. Since node c1 is already low and node o1 is already high, the DC balance preset function does not change the state of the two nodes, as can be seen in FIG. 9.

Once the DC balance reset/precharge is complete, the inv signal is pulsed high and, as shown in FIG. 10, the charge stored at node e1 is shared with node c1 through transistor Q9. Causing node c1 to go high turns on transistor Q11 and transitions node o1 from high to low. The transition of node o1 from high to low supplies the pixel with the proper DC balancing.

Upon completion of the DC balance process, one display cycle is complete and the reset/precharge operation is repeated. Display cycles are repeated for each grayscale bit for the color to be displayed. It should be noted that writing the input bit into the input storage block and displaying the drive bit from the drive storage block or the DC balance block are independent operations that can occur during overlapping time periods. That is, a new input bit may be written into the input storage block while a drive bit is being displayed. Providing the independent operation of writing and displaying can eliminate the need for blanking frames that may be necessary while an entire frame of input bits is being written to an array of pixel cells.

Because all of the storage nodes are dynamic storage nodes, the transistor count and area requirement are kept to minimums. In addition, the dynamic storage nodes enable a low power mode of operation with no direct DC leakage paths.

Figure 11:
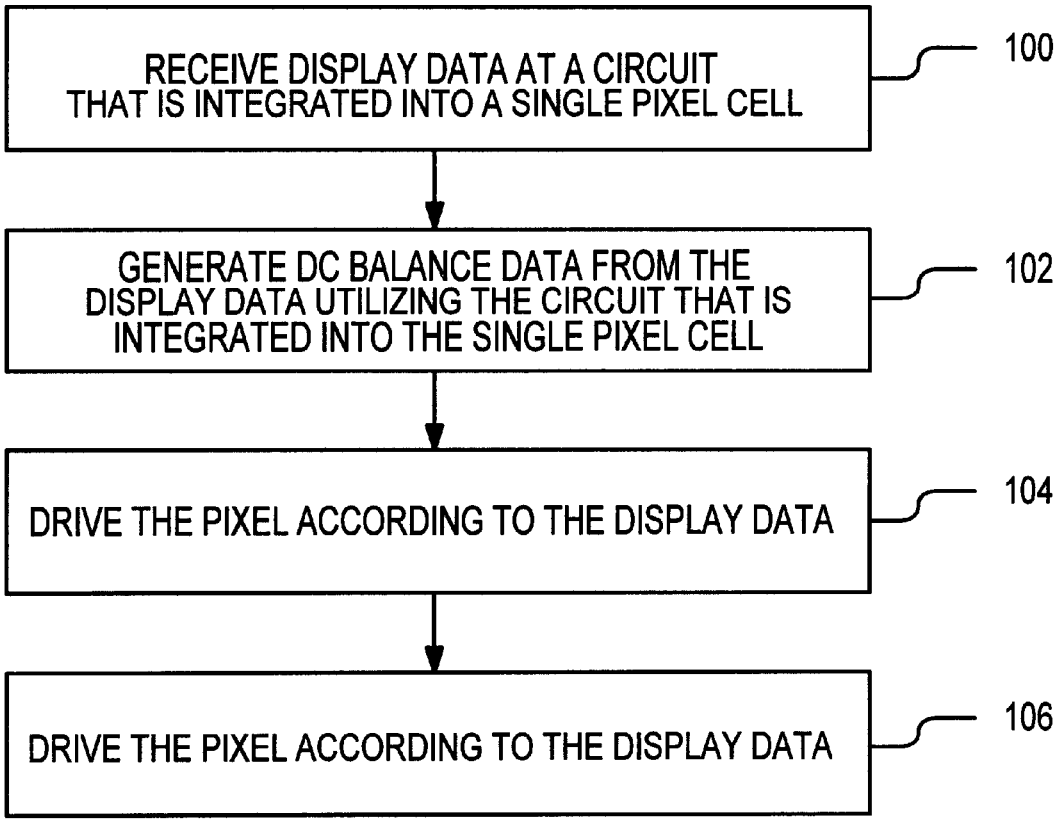
FIG. 11 is a process flow diagram of a preferred method for driving a pixel in accordance with the invention.

FIG. 11 is a process flow diagram of a preferred method of the invention. In step 100, display data is received at a circuit that is integrated into a single pixel cell. In a step 102, DC balance data is generated from the display data utilizing the circuit that is integrated into the single pixel cell. In a step 104, the single pixel cell is driven according to the display data. In a step 106, the single pixel cell is driven according to the DC balance data.

What is claimed:

1. In a display device having a display area formed of an array of pixels for which optical properties of the individual pixels are determined by display data, each individual pixel comprising:

means for receiving and holding inputs of display data, said means for receiving and holding being dedicated to said individual pixel;

means, operatively associated with said means for receiving and holding, for generating DC balance data from said display data and for holding said DC balance data, said means for generating and holding said DC balance data being dedicated to said individual pixel, said means for generating and holding being cooperative with said means for receiving and holding such that said display data is simultaneously held with said DC balance data for each input of said display data; and means, operatively associated with said means for receiving and holding said display data and said means for generating and holding said DC balance data, for multiplexing said display data and said DC balance data to a pixel driver in order to drive said individual pixel according to said display data and said DC balance data.

2. The pixel of claim 1 wherein said means for generating DC balance data includes a dynamic inverter that inverts said display data.

3. The pixel of claim 2 wherein said means for generating DC balance data includes a frame transfer circuit that has a first conductive path that splits into two separate conductive paths, wherein said two conductive paths are controlled by a global transfer signal and one of said conductive paths is connected to said dynamic inverter.

4. The pixel of claim 1 wherein said means for receiving and holding said display data includes an input connected to receive a global reset signal that globally resets said means for receiving and holding of all pixels in said array.

5. The pixel of claim 4 wherein said means for receiving and holding said display data includes a first dynamic storage node for holding a first bit of said display data and a second dynamic storage node for holding a second bit of said display data, wherein said first and second bits are stored simultaneously.

6. A method of driving a pixel of a display device comprising steps of:

receiving display data at a circuit that is integrated into a single pixel cell;

generating DC balance data from said display data utilizing said circuit that is integrated into said single pixel cell, said step of generating including duplicating said display data and storing said display data into two separate dynamic storage nodes;

driving said single pixel cell according to said display data; and driving said single pixel cell according to said DC balance data.

7. The method of claim 6 wherein said step of generating DC balance data includes a step of inverting said display data.

8. The method of claim 7 wherein said step of inverting includes a step of presetting first and second dynamic storage nodes to known states.

9. The method of claim 6 wherein said step of receiving includes a step of holding a first bit of display data and a second bit of display data simultaneously within said circuit.

10. The method of claim 6 wherein said step of generating includes a step of shifting said display data from an input storage node to a drive storage node and to a DC balance node by activating a global frame transfer signal.

11. The method of claim 10 wherein said step of receiving includes steps of:

holding said display data in a dynamic storage node; and resetting said dynamic storage node by activating a global reset signal.

12. A liquid crystal display (LCD) device including a matrix of pixel cells wherein each pixel cell comprises:

an input storage unit having a bit line input for connection to a bit line and a word line input for connection to a word line, said input storage unit including a circuit for storing display data that is received through said bit line input;

a pixel driver operatively associated with said input storage unit, said pixel driver having an input for receiving said display data and having means for driving a display crystal in response to said display data;

a drive storage unit having an input operatively connected to said input storage unit for receiving said display data and an output operatively connected to said pixel driver for outputting said display data to said pixel driver, said drive storage unit including a circuit for storing said display data; and a DC balance generation and storage unit having an input operatively connected to said input storage unit for receiving said display data and an output operatively connected to said pixel driver for outputting DC balance data to said pixel driver, said DC balance unit including a circuit for converting said display data to DC balance data and for storing said DC balance data.

13. The LCD device of claim 12 wherein said DC balance unit includes an inverter circuit that inverts said display data to convert said display data to said DC balance data.

14. The LCD device of claim 13 wherein said inverter circuit includes two dynamic storage nodes separated by an NMOS transistor.

15. The LDC device of claim 12 wherein said input storage unit includes a global reset input, said input storage unit resetting to a known state in response to receiving a global reset signal via said global reset input.

16. The LCD device of claim 12 further comprising a frame transfer circuit having an input for receiving display data from an output of said input storage unit, a first output for outputting display data to said input of said drive storage unit, and a second output for outputting display data to said input of said DC balance unit.

17. The LCD device of claim 16 wherein said frame transfer circuit includes two transistors having gates that are connected to a global transfer signal input, said two transistors defining conductive paths to said first and second outputs in response to receiving a global transfer signal via said global transfer input.

18. The LCD device of claim 17 further comprising a multiplexer connected between said drive storage unit output, said DC balance unit output, and said pixel driver input, said multiplexer defining a conductive path between said DC balance unit and said pixel driver input in response to an invert signal.

19. The LCD device of claim 12 wherein said input storage unit, said drive storage unit, and said DC balance unit include a dynamic storage node.

* * * * *